US009528251B2

(12) United States Patent
Huang

(10) Patent No.: US 9,528,251 B2
(45) Date of Patent: Dec. 27, 2016

(54) WATER OUTPUT SWITCHING STRUCTURE FOR A BATH TUB

(71) Applicant: Xiamen Runner Industrial Corporation, Xiamen (CN)

(72) Inventor: Jian-Ke Huang, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 0 days.

(21) Appl. No.: 14/795,166

(22) Filed: Jul. 9, 2015

(65) Prior Publication Data

US 2016/0053470 A1 Feb. 25, 2016

(30) Foreign Application Priority Data

Aug. 25, 2014 (CN) ..... 2014 2 0480312 U

(51) Int. Cl.
*F16K 21/00* (2006.01)
*E03C 1/04* (2006.01)

(52) U.S. Cl.
CPC ..... *E03C 1/0404* (2013.01); *E03C 2201/30* (2013.01)

(58) Field of Classification Search
CPC ..... E03C 2201/30; E03C 1/0404; Y10T 137/2668; Y10T 137/9464; Y10T 137/8782; Y10T 137/87796; Y10T 137/87812
USPC ..... 137/801, 119.01, 876, 873, 875; 4/678
See application file for complete search history.

(56) References Cited

U.S. PATENT DOCUMENTS 2,507,467 A * 5/1950 Fredrickson ..... E03C 1/04 137/119.01
3,576,197 A * 4/1971 Bastian ..... F16K 11/0655 137/359
3,746,031 A * 7/1973 Christiansen ..... E03C 1/0404 137/119.08
3,906,990 A * 9/1975 Nelson ..... E03C 1/042 137/359
3,939,865 A * 2/1976 Nelson ..... E03C 1/042 137/467
4,015,632 A * 4/1977 Frahm ..... F16K 1/32 137/801
4,171,005 A * 10/1979 Nicklas ..... B05B 1/3006 137/467
5,158,234 A * 10/1992 Magnenat ..... B05B 1/1618 239/447
5,184,777 A * 2/1993 Magnenat ..... B05B 1/1618 239/446

(Continued)

*Primary Examiner* — Kevin Murphy
*Assistant Examiner* — Minh Le
(74) *Attorney, Agent, or Firm* — Chun-Ming Shih

(57) ABSTRACT

A water output switching structure for a bath tub includes a shell; and a water inlet chamber. The shell is of a cylindrical shape, and the water inlet chamber is sleeved around by the rear end of an inner chamber of the shell placed laterally, while a lower side at a front end of the water inlet chamber is provided with a water output hole. A lower end of the guide rod is connected to and acting in cooperation with the extension portion, so that when the guide rod is pulled up, the switching valve core is swung downward to seal off the water output hole, and when the guide rod is pressed downward, the switching valve core is swung upward to open up the water output hole. The water output switching structure for a bath tub occupies less space and provides tight seal.

7 Claims, 2 Drawing Sheets

(56) References Cited

U.S. PATENT DOCUMENTS 5,279,005 A * 1/1994 Valley ..... E03C 1/042 137/467
6,009,904 A * 1/2000 Yang ..... E03C 1/0404 137/119.05
6,301,727 B1 * 10/2001 Bertrand ..... E03C 1/042 137/359
6,334,463 B1 * 1/2002 Lee ..... E03C 1/0404 137/360
6,925,662 B1 * 8/2005 Tan ..... E03C 1/0404 137/801
7,258,322 B1 * 8/2007 Yang ..... E03C 1/0404 137/801
7,618,067 B2 * 11/2009 Danboise ..... F16L 47/28 285/141.1
8,176,580 B2 * 5/2012 Kajuch ..... E03C 1/04 137/467
8,424,781 B2 * 4/2013 Rosko ..... B05B 1/1609 239/446
8,566,975 B1 * 10/2013 Lin ..... F16K 3/0218 137/801
8,857,471 B2 * 10/2014 Huang ..... F16K 3/0227 137/801
9,328,487 B2 * 5/2016 Wernke ..... E03C 1/0408
2001/0020302 A1 * 9/2001 Bosio ..... B05B 1/1618 4/677
2008/0105764 A1 * 5/2008 Jianglin ..... B05B 1/1618 239/526
2009/0205128 A1 * 8/2009 Jones ..... E03C 1/0404 4/678
2012/0234419 A1 * 9/2012 Hsieh ..... F16K 3/0218 137/801
2012/0266993 A1 * 10/2012 Huang ..... F16K 1/12 137/874
2012/0280068 A1 * 11/2012 Huang ..... E03C 1/0404 239/586
2015/0152626 A1 * 6/2015 Huang ..... E03C 1/0404 137/119.05

* cited by examiner

WATER OUTPUT SWITCHING STRUCTURE FOR A BATH TUB

BACKGROUND OF THE INVENTION

Field of the Invention

The present invention relates to a water output switching structure, and in particular to a water output switching structure for a bath tub.

The Prior Arts

For a conventional bath tub, water is output from a faucet downward in a vertical direction, such that the water jets thrust directly downward, to cause water to sputter and spread around.

Therefore, presently, the design and performance of a water output structure for a bath tub is not quite satisfactory, and it leaves much room for improvement.

SUMMARY OF THE INVENTION

In view of the problems and drawbacks of the prior art, the present invention provides a water output switching structure for a bath tub, to overcome the shortcomings of the prior art.

A major objective of the present invention is to provide a water output switching structure for a bath tub, comprising: a shell and a water inlet chamber. Wherein, the water inlet chamber is sleeved around by the rear end of the inner chamber of the cylindrical shell placed laterally, while the lower side at the front end of the water inlet chamber is provided with a water output hole, in communication with a water output chamber at the front end of an inner chamber of the shell. The front end of the shell is provided with a water output port connected to the water output chamber. The front end of the inner chamber of the water inlet chamber is provided with a switching valve core, while the front end of switching valve core is provided with an extension portion penetrating through the connection hole on the front end wall of the water inlet chamber and extending into the water output chamber. On the upper side of the shell is disposed vertically a guide rod penetrating through a through hole on the upper side wall of the shell and extending into the water output chamber. The lower end of the guide rod is connected to and acting in cooperation with the extension portion, so that when the guide rod is pulled up, the switching valve core is swung downward to seal off the water output hole; and when the guide rod is pressed downward, the switching valve core is swung upward to open up the water output hole.

According to an aspect of the present invention, on the guide rod is sleeved around by a compression spring, with its upper end fixed to the inner wall of the shell, and with its lower end fixed to the extension portion, to keep the switching valve core in a swing downward position.

According to another aspect of the present invention, a long hole is provided on the extension portion. The low end of the guide rod is provided with a shrink neck fastened into the long hole. The upper end of the guide rod is provided with a pull rod head.

According to a yet another aspect of the present invention, a water seal plate is disposed on the lower side face of the switching valve core facing and acting in cooperation with the water output hole.

According to a further aspect of the present invention, a first seal ring is embedded inside the connection hole to form tight seal with the front end of the switching valve core.

According to another aspect of the present invention, a second seal ring is sandwiched between the outer perimeter wall of the water inlet chamber and the inner wall of the shell, and a tail sleeve is sleeved around by the rear end of inner chamber of the water inlet chamber. Through the outer threads of its outer perimeter wall, the tail sleeve is connected rotatably and acting in cooperation with the water inlet chamber, through the inner threads of its inner perimeter wall. A third seal ring is sandwiched between the outer perimeter wall of the tail sleeve, and the inner perimeter wall of the water inlet chamber. The inner perimeter wall at the water inlet end of the tail sleeve is provided with inner threads to connect to and act in cooperation with the water supply pipe line.

Compared with the prior art, the present invention has the following advantages: water is output from the side of a bath tub, so that water jets will not thrust down to sputter and spread around, and it can be adjusted easily. In addition, the space required for its operation is minimal, to achieve tight seal and avoid leakage.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
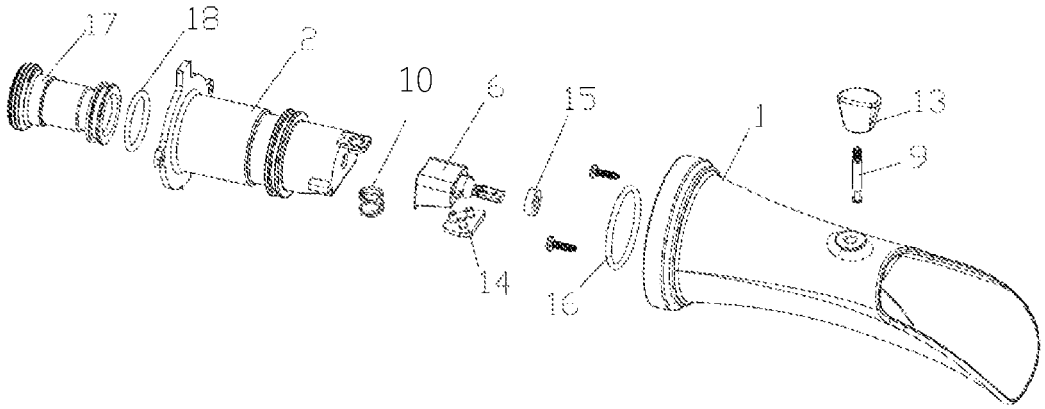
FIG. 1 is an exploded view of a water output switching structure for a bath tub according to an embodiment of the present invention.
Figure 2:
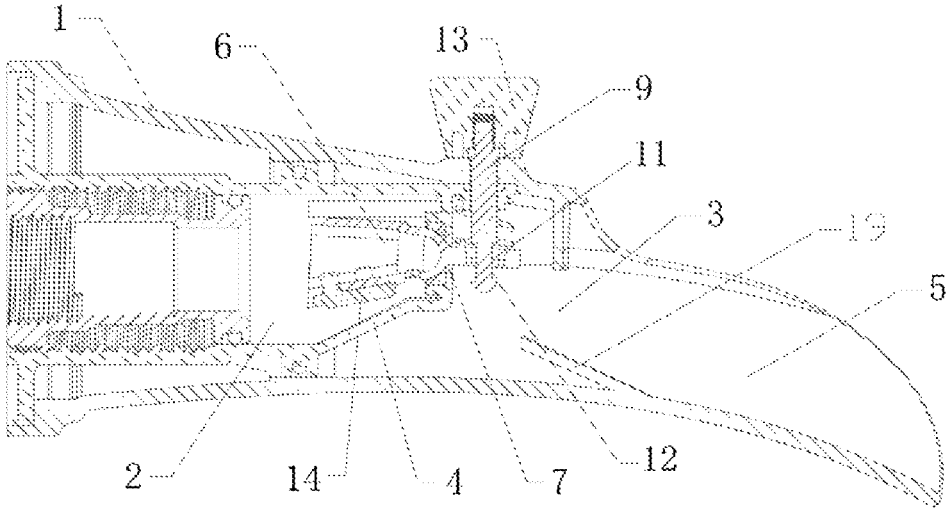
FIG. 2 is a schematic diagram of a water output switching structure for a bath tub according to an embodiment of the present invention when the water output hole is opened.
Figure 3:
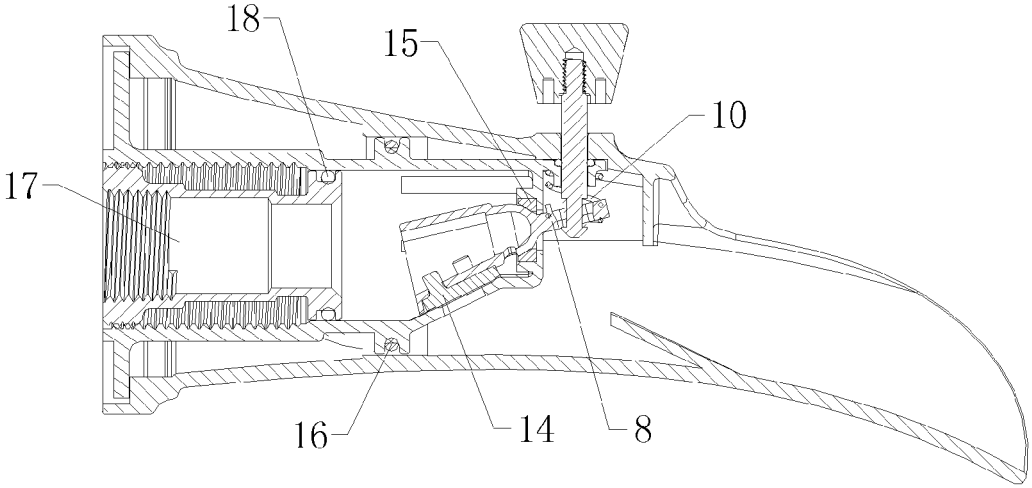
FIG. 3 is a schematic diagram of a water output switching structure for a bath tub according to an embodiment of the present invention when the water output hole is closed.

Refer to FIGS. 1 to 3 respectively for an exploded view of a water output switching structure for a bath tub according to an embodiment of the present invention; a schematic diagram of a water output switching structure for a bath tub according to an embodiment of the present invention when the water output hole is opened; and a schematic diagram of a water output switching structure for a bath tub according to an embodiment of the present invention when the water output hole is closed. As shown in FIGS. 1 to 3, the water output switching structure for a bath tub of the present invention includes a cylindrical shell 1 and a water inlet chamber 2. Wherein, the water inlet chamber 2 is sleeved around by the rear end of an inner chamber of the shell 1, while the front end of the water inlet chamber 2 is fixed and connected to the rear end of the shell 1 through bolts. The lower side of the front end of the water inlet chamber 2 is provided with a water output hole 4, in communication with a water output chamber 3 at the front end of the inner chamber of the shell 1. The front end of the shell 1 is provided with a water output port 5 connected to the water output chamber 3, and a projection 19 protruded from an inner wall of the shell around the water output port 5. The front end of the inner chamber of the water inlet chamber 2 is provided with a switching valve core 6, while the front end of switching valve core 6 is provided with an extension portion 8 penetrating through a connection hole 7 on the upper end wall of the inlet chamber 2 and extending into the water output chamber 3. On the upper side of the shell 1 is disposed vertically a guide rod 9 penetrating through a through hole on the upper side wall of the shell 1 and extending into the water output chamber 3. The lower end of the guide rod 9 is connected and acting in cooperation with the extension portion 8, so that when the guide rod 9 is pulled up, the switching valve core 6 is swung downward to seal off the water output hole 4; and when the guide rod 9 is pressed downward, the switching valve core 6 is swung upward to open up the water output hole 4. Through utilizing the guide rod 9 to bring the switching valve core 6 into swing by means of the lever principle, the guide rod 9 is only required to move a short distance to realize the open and close of the water output hole 4. Therefore, it can be operated in a small space, such that the operation space required is minimal.

In the present embodiment, on the guide rod 9 is sleeved around by a compression spring 10, with its upper end fixed to the inner wall of the shell 1, and with its lower end fixed to the extension portion 8, to keep the switching valve core 6 in a swing downward position, to seal off the water output hole 4. When it is required to open the water output hole 4, the guide rod 9 is pressed downward, to act against the compression spring 10, to make the switching valve core 6 swing upward, to open up the water output hole 4.

Also, in the present embodiment, a long hole 11 is provided on the extension portion 8. The low end of the guide rod 9 is provided with a shrink neck 12 fastened into the long hole 11, to realize the connection of the guide rod 9 and the extension portion 8, and to bring the extension portion 8 to move upward and downward along with the guide rod 9. The upper end of the guide rod 9 is provided with a pull rod head 13, such that through its inner threads, the pulling rod head 13 is rotatably connected and fixed onto the guide rod 9, to facilitate manual control and operation of the guide rod 9.

Moreover, in the present embodiment, a water seal plate 14 is disposed on the lower side face of the switching valve core 6 acting in cooperation with the water output hole 4. The water seal plate 14 is an encapsulated seal plate, to enhance the tight seal between the switching valve core 6 and the water output hole 4, when the water output hole is closed. Meanwhile, inside the switching valve core 6 is provided with a cavity, and the rear end of the cavity is in communication with the water inlet chamber 2. When the switching valve core 6 is swung downward to seal off the water output hole 4, pressure produced by the water in the water inlet chamber 2 could exert a downward force on the switching valve core 6, to ensure tight seal and avoid leakage.

In addition, in the present embodiment, a first seal ring 15 is embedded inside the connection hole 7 to form tight seal with the front end of the switching valve core 6.

Further, in the present embodiment, a second seal ring 16 is sandwiched between the outer perimeter wall of the water inlet chamber 2 and the inner wall of the shell 1, and a tail sleeve 17 is sleeved around by the rear side of inner chamber of the water inlet chamber 2. Through the outer threads of its outer perimeter wall, the tail sleeve 17 is connected rotatably and acting in cooperation with the water inlet chamber 2, through the inner threads of its inner perimeter wall. A third seal ring 18 is sandwiched between the outer perimeter wall of the tail sleeve 17, and the inner perimeter wall of the water inlet chamber 2. The inner perimeter wall at the water inlet end of the tail sleeve 17 is provided with inner threads to connect and act in cooperation with water supply pipe line. Through adding the tail sleeve 17, and by connecting the tail sleeve 17 to the water supply pipe line, maintenance and repair is made easier, thus reducing maintenance cost, and the processing difficulty of the water output switching structure for a bath tub.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A water output switching structure for a bath tub, comprising:

a shell; and a water inlet chamber wherein, the shell is of a cylindrical shape, and the water inlet chamber is sleeved around by a rear end of an inner chamber of the shell placed laterally, while a lower side at a front end of the water inlet chamber is provided with a water output hole, in communication with a water output chamber at the front end of the inner chamber of the shell, the front end of the shell is provided with a water output port connected to the water output chamber, and the front end of the water inlet chamber is provided with a switching valve core, the front end of switching valve core is integrally provided with an extension portion penetrating through a connection hole on a front end wall of the water inlet chamber and extending into the water output chamber, on an upper side of the shell is disposed vertically a guide rod penetrating through a through hole on an upper side wall of the shell and extending into the water output chamber, a lower end of the guide rod is connected to and acting in cooperation with the extension portion, so that, via a seesaw pivot of the switching valve core around the connection hole, when the guide rod is pulled up, the switching valve core is swung downward to seal off the water output hole, and when the guide rod is pressed downward, the switching valve core is swung upward to open up the water output hole.

2. A water output switching structure for a bath tub, comprising:

a shell; and a water inlet chamber, wherein, the shell is of a cylindrical shape, and the water inlet chamber is sleeved around by a rear end of an inner chamber of the shell placed laterally, while a lower side at a front end of the water inlet chamber is provided with a water output hole, in communication with a water output chamber at the front end of the inner chamber of the shell, the front end of the shell is provided with a water output port connected to the water output chamber, and the front end of the inner chamber of the water inlet chamber is provided with a switching valve core, the front end of switching valve core is provided with an extension portion penetrating through a connection hole on a front end wall of the water inlet chamber and extending into the water output chamber, on an upper side of the shell is disposed vertically a guide rod penetrating through a through hole on an upper side wall of the shell and extending into the water output chamber, a lower end of the guide rod is connected to and acting in cooperation with the extension portion, so that when the guide rod is pulled up, the switching valve core is swung downward to seal off the water output hole, and when the guide rod is pressed downward, the switching valve core is swung upward to open up the water output hole;

wherein the guide rod is sleeved around by a compression spring, with the upper end of the compression spring fixed to the inner wall of the shell, and with the lower end of the guide rod fixed to the extension portion, to keep the switching valve core in a swing downward position.

3. The water output switching structure for a bath tub as claimed in claim 2, wherein a long hole is provided on the extension portion, the lower end of the guide rod is provided with a shrink neck fastened into the long hole, the upper end of the guide rod is provided with a pull rod head.

4. The water output switching structure for a bath tub as claimed in claim 1, wherein a water seal plate is disposed on the lower side face of the switching valve core facing and acting in cooperation with the water output hole.

5. A water output switching structure for a bath tub, comprising:

a shell; and a water inlet chamber, wherein, the shell is of a cylindrical shape, and the water inlet chamber is sleeved around by a rear end of an inner chamber of the shell placed laterally, while a lower side at a front end of the water inlet chamber is provided with a water output hole, in communication with a water output chamber at the front end of the inner chamber of the shell, the front end of the shell is provided with a water output port connected to the water output chamber, and the front end of the inner chamber of the water inlet chamber is provided with a switching valve core, the front end of switching valve core is provided with an extension portion penetrating through a connection hole on a front end wall of the water inlet chamber and extending into the water output chamber, on an upper side of the shell is disposed vertically a guide rod penetrating through a through hole on an upper side wall of the shell and extending into the water output chamber, a lower end of the guide rod is connected to and acting in cooperation with the extension portion, so that when the guide rod is pulled up, the switching valve core is swung downward to seal off the water output hole, and when the guide rod is pressed downward, the switching valve core is swung upward to open up the water output hole;

wherein a first seal ring is embedded inside the connection hole to form tight seal with the front end of the switching valve core.

6. The water output switching structure for a bath tub as claimed in claim 5, wherein a second seal ring is sandwiched between an outer perimeter wall of the water inlet chamber and the inner wall of the shell, and a tail sleeve is sleeved around by the rear end of an inner chamber of the water inlet chamber, through its outer threads of the outer perimeter wall, the tail sleeve is connected rotatably and acting in cooperation with the water inlet chamber, through the inner threads of its inner perimeter wall, a third seal ring is sandwiched between the outer perimeter wall of the tail sleeve, and the inner perimeter wall of the water inlet chamber, the inner perimeter wall at a water inlet end of the tail sleeve is provided with inner threads to connect to and act in cooperation with a water supply pipe line.

7. The water output switching structure for a bath tub as claimed in claim 1, wherein the front end of the shell is provided with a projection protruded from an inner wall of the shell around the water output port.

* * * * *